US011639773B2

(12) United States Patent
Ahmed et al.

(10) Patent No.: US 11,639,773 B2
(45) Date of Patent: May 2, 2023

(54) SYSTEMS AND METHODS FOR TRANSPORTING NATURAL GAS

(71) Applicants: Feisal Ahmed, Houston, TX (US); Daniel E Elvera, Houston, TX (US)

(72) Inventors: Feisal Ahmed, Houston, TX (US); Daniel E Elvera, Houston, TX (US)

( * ) Notice: Subject to any disclaimer, the term of this patent is extended or adjusted under 35 U.S.C. 154(b) by 595 days.

(21) Appl. No.: 16/751,461

(22) Filed: Jan. 24, 2020

(65) Prior Publication Data

US 2021/0231265 A1 Jul. 29, 2021

(51) Int. Cl.
*F17C 7/02* (2006.01)

(52) U.S. Cl.
CPC ..... *F17C 7/02* (2013.01); *F17C 2205/0352* (2013.01); *F17C 2221/033* (2013.01); *F17C 2227/0157* (2013.01); *F17C 2227/0337* (2013.01); *F17C 2270/0118* (2013.01)

(58) Field of Classification Search
CPC ..... F17C 7/02; F17C 2205/0352; F17C 2221/033; F17C 2227/0157; F17C 2227/0337; F17C 2270/0118
USPC ..... 137/14
See application file for complete search history.

(56) References Cited

U.S. PATENT DOCUMENTS 3,232,725 A * 2/1966 Secord ..... F25J 1/0254 48/190
4,846,088 A * 7/1989 Fanse ..... B63B 25/14 114/72
5,912,424 A * 6/1999 Judkins ..... F17C 11/00 95/143
6,932,121 B1 * 8/2005 Shivers, III ..... F17C 3/025 405/59
7,155,918 B1 * 1/2007 Shivers, III ..... B63B 25/16 62/53.2

(Continued)

FOREIGN PATENT DOCUMENTS

CN 202691587 U 1/2013
WO 0220352 A1 3/2002

(Continued)

OTHER PUBLICATIONS

International Search Report and Written Opinion dated Apr. 26, 2021 for corresponding PCT Application No. PCT/US2021/013354 filed on Jan. 14, 2021.

*Primary Examiner* — Jason K Niesz
(74) *Attorney, Agent, or Firm* — Chamberlain, Hrdlicka, White, Williams & Aughtry

(57) ABSTRACT

A system for transporting natural gas. The system may include a loading facility, a first storage system, a second storage system, and a CNG carrier. The loading facility may be operable to receive, compress, and chill natural gas while maintaining the natural gas in a gaseous state, and further operable to transfer the chilled CNG at a constant flowrate. The first storage system may be operable to receive chilled CNG from the loading facility at the constant flowrate, store the chilled CNG, and transfer the chilled CNG. The second storage system may be operable to receive and store the chilled CNG. The CNG carrier may be operable to receive chilled CNG from the first storage system, transport the chilled CNG, and transfer the chilled CNG to the second storage system. The system may be sized such that the constant flowrate of the chilled CNG is maintained without interruption.

20 Claims, 8 Drawing Sheets

(56) References Cited

U.S. PATENT DOCUMENTS

| | | | | |
|---|---|---|---|---|
| 7,240,498 | B1 * | 7/2007 | Shivers, III | F17C 13/08 62/48.1 |
| 8,402,983 | B2 * | 3/2013 | Harland | B63B 22/026 137/236.1 |
| 9,109,751 | B2 * | 8/2015 | Schimp | F17C 5/06 |
| 2003/0061820 | A1 * | 4/2003 | Bishop | F17C 13/002 62/53.2 |
| 2004/0140100 | A1 * | 7/2004 | Wijngaarden | F17C 3/005 166/267 |
| 2010/0000252 | A1 * | 1/2010 | Morris | B63B 25/16 62/53.2 |
| 2014/0299039 | A1 * | 10/2014 | Trollux | B63B 27/24 114/74 R |
| 2015/0211684 | A1 * | 7/2015 | Santos | F17C 11/007 137/1 |
| 2017/0130901 | A1 * | 5/2017 | Sloan | F17C 5/06 |

FOREIGN PATENT DOCUMENTS

| | | | |
|---|---|---|---|
| WO | 2006089042 | A2 | 8/2006 |
| WO | 2013083167 | A1 | 6/2013 |

* cited by examiner

SYSTEMS AND METHODS FOR TRANSPORTING NATURAL GAS

BACKGROUND

This section is intended to provide relevant background information to facilitate a better understanding of the various aspects of the described embodiments. Accordingly, it should be understood that these statements are to be read in this light and not as admissions of prior art.

The need for transportation of gas has increased as gas resources have been established around the globe. Traditionally, only a few methods have proved viable in transporting gas from these remote locations to places where the gas can be used directly or processed into commercial products. The typical method is to simply build a pipeline to transport the gas directly to a desired location. However, building a pipeline is, in many cases, not possible due to environmental, geopolitical or economic constraints Due to the limitations of pipelines, other transportation methods have emerged, such as transporting natural gas in a liquid state. However, natural gas must be treated and cooled to −160° C. (−256° F.) to be liquefied. The liquefied natural gas ("LNG") must then be maintained at −160° C. (−256° F.) during transportation. Specialized materials and equipment must be used due to the temperatures involved with producing and storing LNG, increasing the cost to transport the natural gas. Additionally, LNG must be regasified once it reaches its destination, further increasing the costs involved with transporting LNG.

Further, existing methods of transporting compressed natural gas ("CNG") may require compression, chilling, and/or heating at each location where the CNG is transferred from one storage containment system to another storage containment system. Therefore, costly equipment is required at each storage location to perform these operations when transporting and storing CNG.

BRIEF DESCRIPTION OF THE DRAWINGS

The present disclosure is described with reference to the following figures. The same numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

The present disclosure provides systems and methods for transporting natural gas. The systems and methods provide for transportation of natural gas such that natural gas is loaded at the supply source at a constant flowrate and without interruption, and/or offloaded at the delivery location at a constant flowrate and without interruption.

Figure 1:
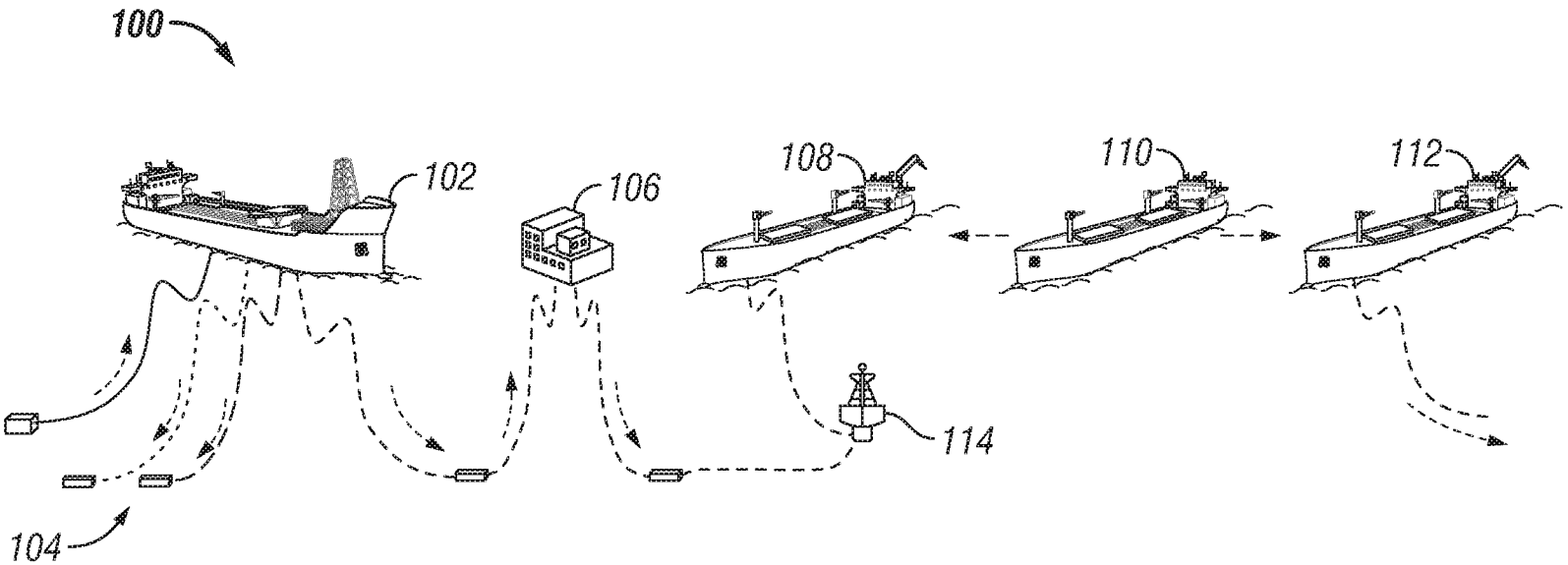
FIG. 1 is a diagram of system for transporting natural gas, according to one or more embodiments.

FIG. 1 a diagram of system 100 for transporting natural gas, according to one or more embodiments. The system 100 includes a production vessel 102 receiving natural gas from an offshore gas supply source 104, a loading facility 106, an offshore storage system 108, a compressed natural gas ("CNG") carrier 110, and a storage and offloading facility 112. In at least one embodiment, the production vessel 102 is a floating production, storage, and offloading facility ("FPSO"). In other embodiments, the production vessel 102 may be a drillship, semi-submersible, fixed platform, or any other offshore production facility that can provide natural gas to the loading facility 106.

The system also includes one or more loading buoys 114 to transfer chilled CNG between the loading facility 106 and the offshore storage system 108. In some embodiments, additional loading buoys 114 may be utilized to transfer natural gas or chilled CNG between the production vessel 102, the loading facility 106, the offshore storage system 108, the CNG carrier 110, and/or the storage and offloading facility 112. In other embodiments, any one or more of the transfers of natural gas or chilled CNG between the various portions of the system 100 may be done with another gas transfer mechanism (such as flexible hoses, loading arms, etc.), and without the use of a loading buoy 114.

As shown in FIG. 1, the loading facility 106 receives natural gas from production vessel 102. The loading facility then compresses and chills the natural gas, as described in more detail below with reference to FIG. 2, to a temperature of 0° C. (32° F.) or lower and a pressure of 8,274 kPa (1,200 pounds per square inch ("psi")) or higher while maintaining the chilled CNG in a gaseous state. The loading facility 106 then uses a liquid displacement system, which is also described in more detail below with reference to FIGS. 3-5, to transfer the chilled CNG to the offshore storage system 108 while maintaining the chilled CNG in a gaseous state at or below 0° C. (32° F.) and at or above 8,274 kPa (1,200 psi).

Once the chilled CNG is stored in the offshore storage system 108, the chilled CNG is held until it can be offloaded to the CNG carrier 110 and transported to the storage and offloading facility 112. The chilled CNG is then stored in the storage and offloading facility 112 until it is decompressed, heated, and offloaded, as described in more detail below with reference to FIG. 6, to a pipeline or secondary storage facility that stores natural gas. The transfers between the offshore storage system 108, the CNG carrier 110, and the storage and offloading facility 112 are completed utilizing a liquid displacement system, as described below, to maintain the chilled CNG in a gaseous state at or below 0° C. (32° F.) and at or above 8,274 kPa (1,200 psi).

In at least one embodiment, the offshore storage system 108 is sized such that a constant flowrate of natural gas can be produced from the offshore gas supply source 104 without interruption and the storage of the storage and offloading facility 112 is sized such that a constant flowrate of natural gas can be offloaded to a pipeline or offsite storage facility that stores natural gas without interruption. Additionally, the CNG carrier 110 may be sized to deliver sufficient chilled CNG to accommodate the continuous, uninterrupted flow of natural gas, or multiple CNG carriers 110 may be utilized to transport the chilled CNG. In other embodiments, the offshore storage system 108, the storage and offloading facility 112, the CNG carrier 110, or any combination thereof may not be sized to accommodate a continuous, uninterrupted flowrate.

Figure 2:
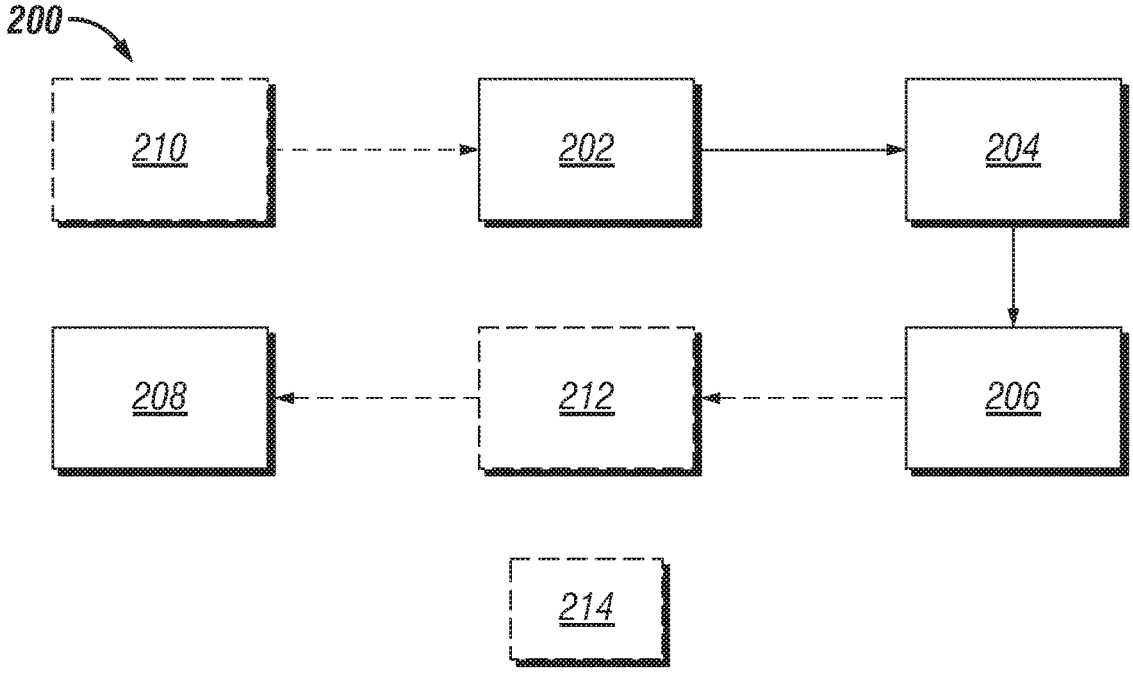
FIG. 2 is a diagram of a loading facility, according to one or more embodiments.

FIG. 2 is a diagram of a loading facility 200, according to one or more embodiments. As discussed above the loading facility 200 compresses and chills the natural gas prior to storage of the chilled CNG. As shown in FIG. 2 the loading facility 200 includes a compression system 202, a refrigeration system 204, a liquid displacement system 206, and a metering system 208.

Natural gas is received by the loading facility and compressed by the compression system 202 to at least 8,274 kPa (1,200 psi) via methods known to those skilled in the art. After compression of the natural gas, it is then chilled to 0° C. (32° F.) or less by the refrigeration system, which utilizes gas refrigeration methods known to those skilled in the art. The liquid displacement system 206 is then used to move the chilled CNG to a metering system, which controls the flowrate of the chilled CNG from the loading facility 200 to a storage system.

The loading facility 200 may also include a production treatment system 210 that treats the incoming natural gas prior to compression. The production treatment system may remove undesired components from the natural gas, separate liquids from the natural gas, or perform any other operations necessary to prepare the natural gas for compression. Additionally, the loading facility may include a storage system 212 that stores the chilled CNG for offloading to the next step in natural gas delivery, as shown in FIG. 1. Further, the storage system 212 may act as the offshore storage system 108, storing chilled CNG for offloading onto a CNG carrier.

The loading facility 200 may also include a power generation system 214. The power generation system 214 utilizes a portion of the natural gas delivered to the loading facility 200 to produce electricity to power the systems of the loading facility 200. In other embodiments, the loading facility 200 may receive electricity from a source external to the loading facility 200. In other embodiments, the production treatment system 210, the storage system 212, and/or the power generation system 214 may be omitted.

Figure 3:
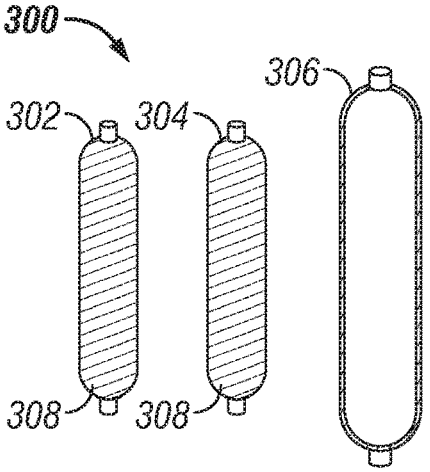
FIG. 3 shows a first step of transferring chilled compressed natural gas ("CNG") with a liquid displacement system.
Figure 4:
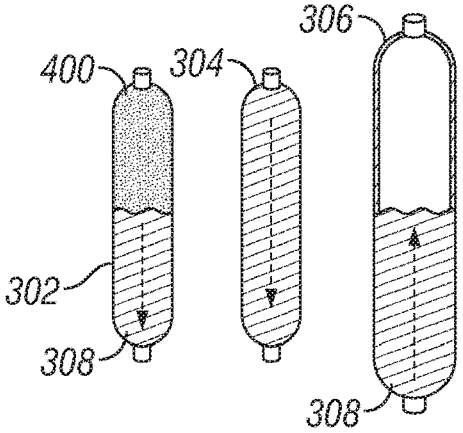
FIG. 4 shows a second step of transferring chilled CNG with the liquid displacement system of FIG. 3.
Figure 5:
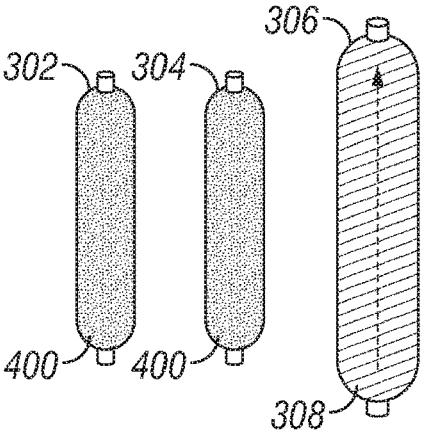
FIG. 5 shows a third step of transferring chilled CNG with the liquid displacement system of FIG. 3.

FIGS. 3-5 illustrate how chilled CNG is transferred utilizing a liquid displacement system 300, according to one or more embodiments. As shown in FIG. 3, two storage containers 302, 304 of three storage containers 302, 304, 306 in fluid communication with each other are pre-charged with a displacement fluid 308, such as ethylene glycol and water mixture, at a similar temperature to the chilled CNG and pressure below the pressure of the chilled CNG. The third storage container 306 will receive the displacement fluid and is sized to contain the volume of displacement fluid within the liquid displacement system 300.

It should be noted that, although FIGS. 3-5 depict three storage containers 302, 304, 306, any number of storage containers can be utilized to transfer the chilled CNG, provided that there is sufficient storage capacity to contain the displacement fluid within the other storage containers of the liquid displacement system. Further, the storage containers may differ in size and/or multiple storage containers may be utilized to receive the displacement fluid contained within the remaining storage containers of the liquid displacement system 300 instead of a single storage container 306.

Chilled CNG 400 is flowed from a loading facility or a storage system, discussed above with reference to FIGS. 1 and 2, into the first storage container 302 containing the displacement fluid 308, as shown in FIG. 4. The introduction of chilled CNG to the first storage container 302 causes the displacement fluid 308 to move through the remaining storage containers 304, 306 as it is displaced and valves or similar methods are utilized to maintain the displacement fluid at a pressure that is below the pressure of the chilled CNG.

As shown in FIG. 5, the flow of chilled CNG 400 is continued until two of the three storage containers 302, 304, 306 are filled with chilled CNG 400 and third storage container 306 is filled with the displacement fluid 308 previously contained within the first two storage containers 302, 304. To transfer the chilled CNG 400 out of the storage containers 302, 304, the process shown in FIGS. 3-5 is reversed and displacement fluid 308 is pumped into the storage containers 302, 304 containing chilled CNG 400 at a pressure that is higher than the pressure of the chilled CNG. The liquid displacement system 300 allows the chilled CNG to be transferred between multiple facilities and storage systems, as shown in FIG. 1, without additional chilling and compression to maintain the temperature below 0° C. (32° F.) and the pressure above 8,274 kPa (1,200 psi).

Figure 6:
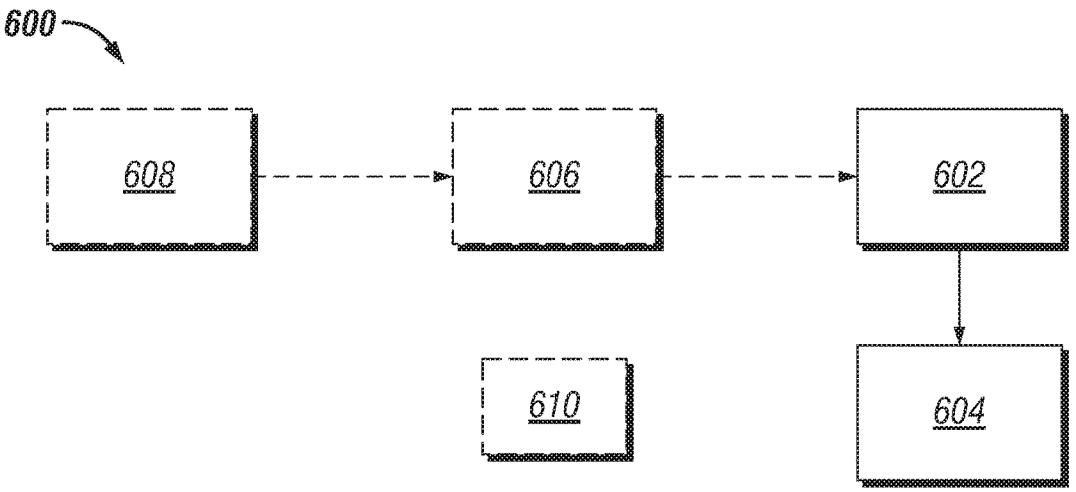
FIG. 6 is a diagram of an offloading facility, according to one or more embodiments.

FIG. 6 is a diagram of an offloading facility 600, according to one or more embodiments. The offloading facility 600 includes a decompression and heating system 602, and a metering system 604. The offloading facility 600 receives the chilled CNG, which is then transferred to the heating and decompression system 602. The heating and decompression system 602 lowers the pressure and raises the temperature of the chilled CNG to a temperature and pressure necessary for the end-use of the natural gas, such as introducing the natural gas to a pipeline or storage in an offsite storage facility, using methods known to those skilled in the art. Additionally, the decompression and heating system 602 may be separated into a heating system and a decompression system. The metering system 604 then controls the transfer of the heated, depressurized natural gas away from the offloading facility 600.

As shown in FIG. 6, the offloading facility 600 may also include a storage system 606 that stores the chilled CNG prior to decompression and heating. The offloading facility 600 may further include a liquid displacement system 608, as described above, in the case when there is no liquid displacement system on the CNG carrier 110. The offloading facility 600 may also include a power generation system 610. The power generation system 610 utilizes a portion of the heated and decompressed natural gas to produce electricity to power the systems of the offloading facility 600. In other embodiments, the offloading facility 600 may receive electricity from a source external to the offloading facility 600. In other embodiments, the liquid displacement system 608, the storage system 606 and/or the power generation system 610 may be omitted.

Figure 7:
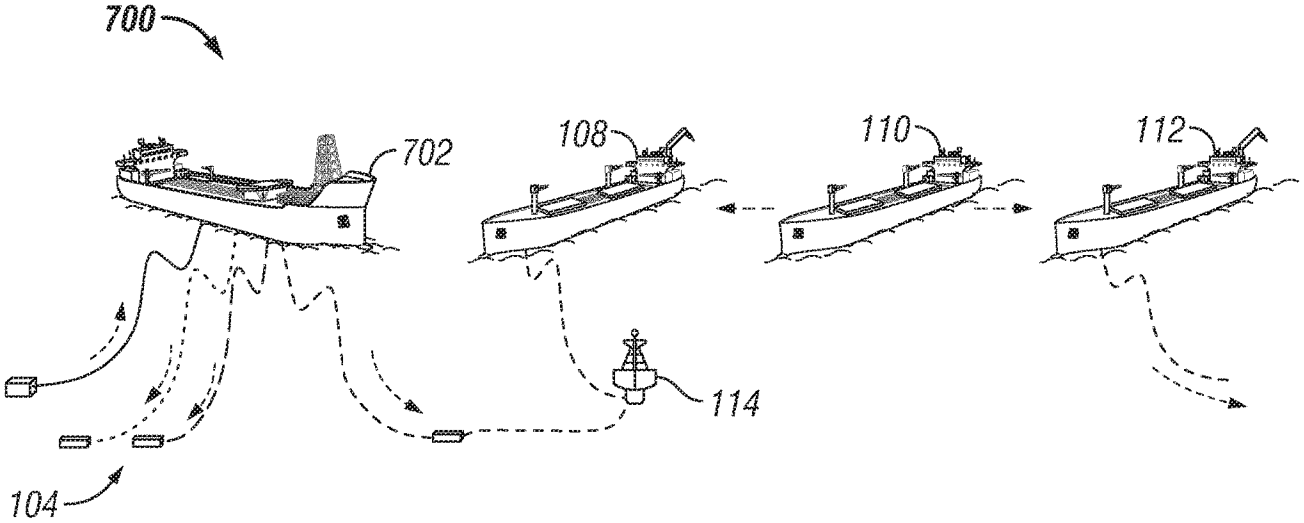
FIG. 7 is a diagram of system for transporting natural gas, according to one or more embodiments.

FIG. 7 a diagram of system 700 for transporting natural gas, according to one or more embodiments. Similar to FIG. 1, the system 700 includes an offshore storage system 108, a CNG carrier 110, and a storage and offloading facility 112. However, a modified FPSO 702 produces natural gas from an offshore gas supply source 104 and houses the compression and refrigeration systems to compress and chill the natural gas. The modified FPSO 702 acts as both the production vessel and the loading facility, converting the natural gas to chilled CNG.

Figure 8:
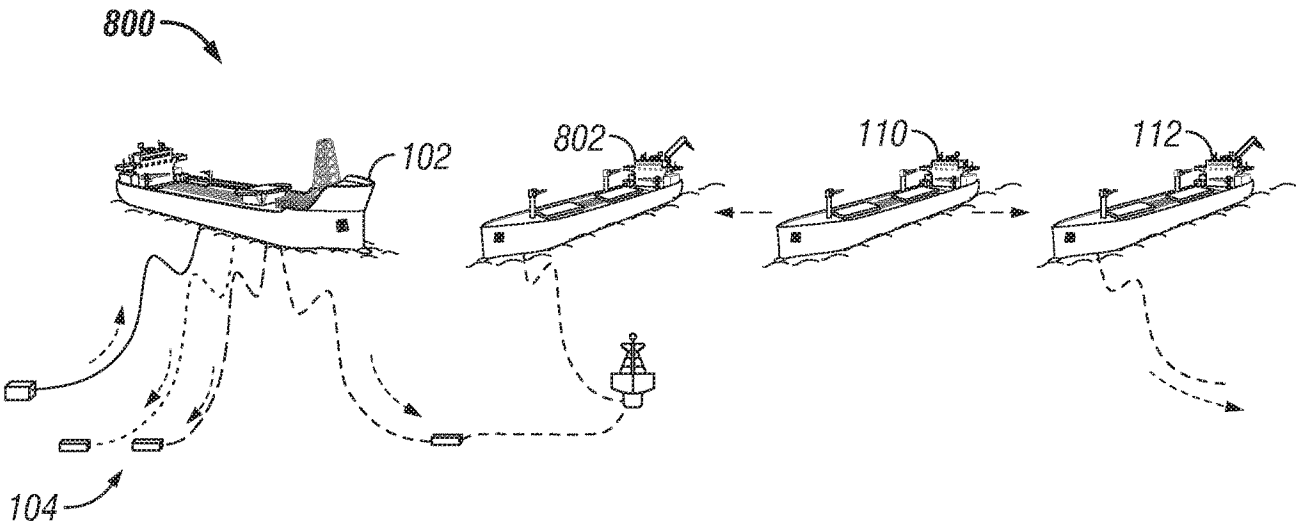
FIG. 8 is a diagram of system for transporting natural gas, according to one or more embodiments.

FIG. 8 a diagram of system 800 for transporting natural gas, according to one or more embodiments. Similar to FIG. 1, the system 800 includes a production vessel 102 receiving natural gas from an offshore gas supply source 104, a CNG carrier 110, and a storage and offloading facility 112. However, a modified offshore storage system 802 acts as both the loading facility and the offshore storage system, converting the natural gas to chilled CNG and storing the chilled CNG.

Figure 9:
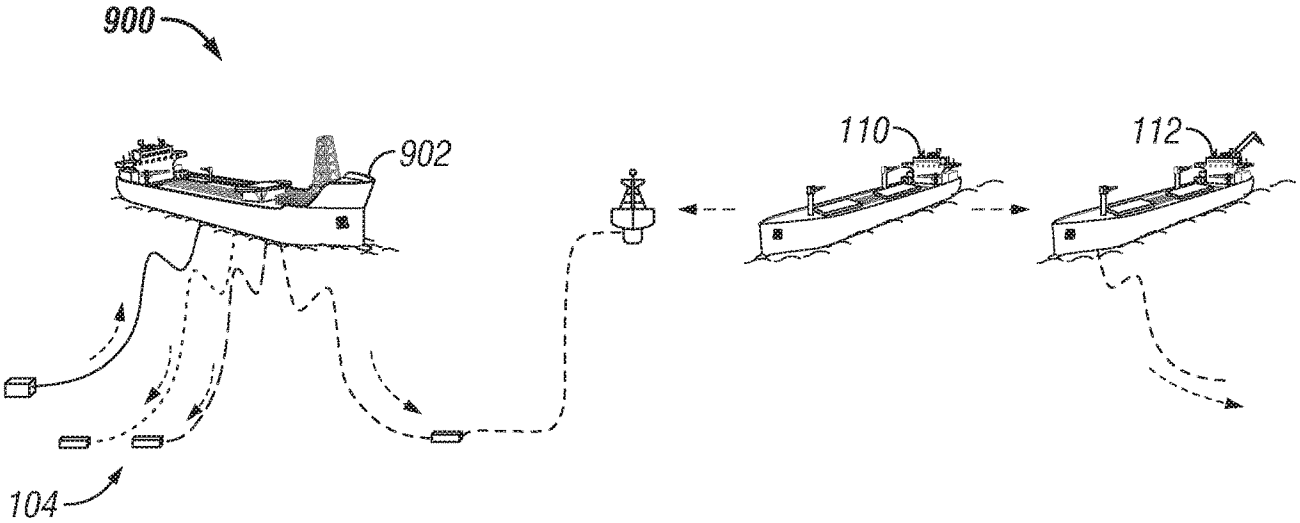
FIG. 9 is a diagram of system for transporting natural gas, according to one or more embodiments.

FIG. 9 a diagram of system 900 for transporting natural gas, according to one or more embodiments. Similar to FIG. 1, the system 900 includes a CNG carrier 110 and a storage and offloading facility 112. However, a floating gas production, storage, and offloading facility ("FGPSO") 902 produces natural gas from an offshore gas supply source 104. The FGPSO 902 acts as a production vessel, a loading facility to convert the natural gas to chilled CNG, and an offshore storage system, storing the chilled CNG for offloading to the CNG carrier 110.

Figure 10:
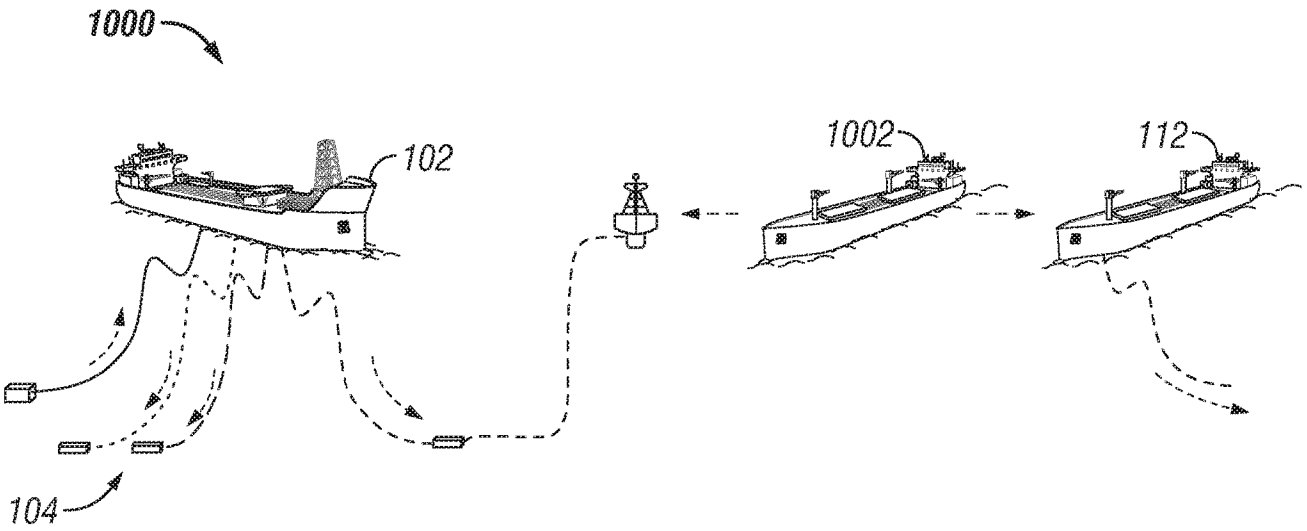
FIG. 10 is a diagram of system for transporting natural gas, according to one or more embodiments.

FIG. 10 a diagram of system 1000 for transporting natural gas, according to one or more embodiments. Similar to FIG. 1, the system 1000 includes a production vessel 102 receiving natural gas from an offshore gas supply source 104 and a storage and offloading facility 112. However, a modified CNG carrier 1002 acts as the loading facility, the offshore storage system, and the CNG carrier.

Figure 11:
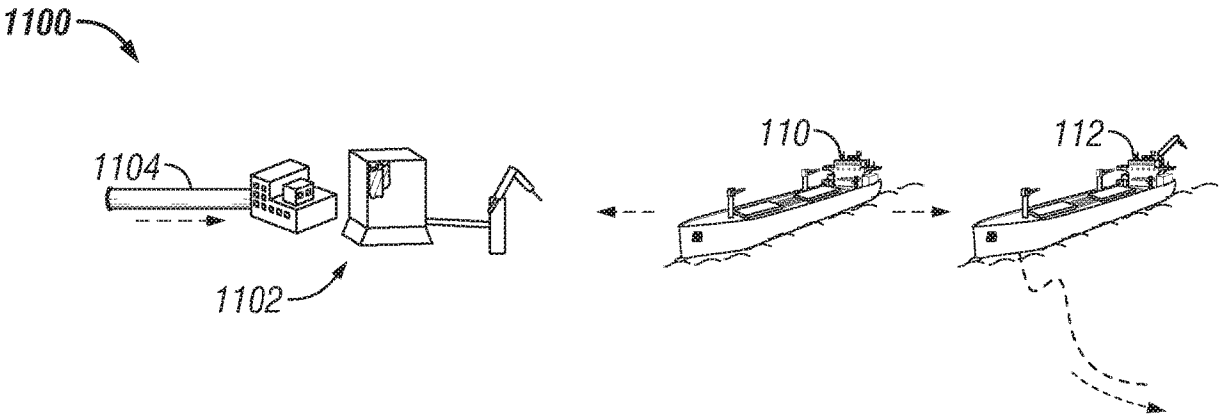
FIG. 11 is a diagram of system for transporting natural gas, according to one or more embodiments.

FIG. 11 a diagram of system 1100 for transporting natural gas, according to one or more embodiments. Similar to FIG. 1, the system 1100 includes a CNG carrier 110 and a storage and offloading facility 112. However, an onshore loading and storage facility 1102 receives natural gas from a pipeline 1104. The onshore loading and storage facility 1102 compresses, chills, and stores the natural gas from the pipeline 1104 for offloading to the CNG carrier 110.

Figure 12:
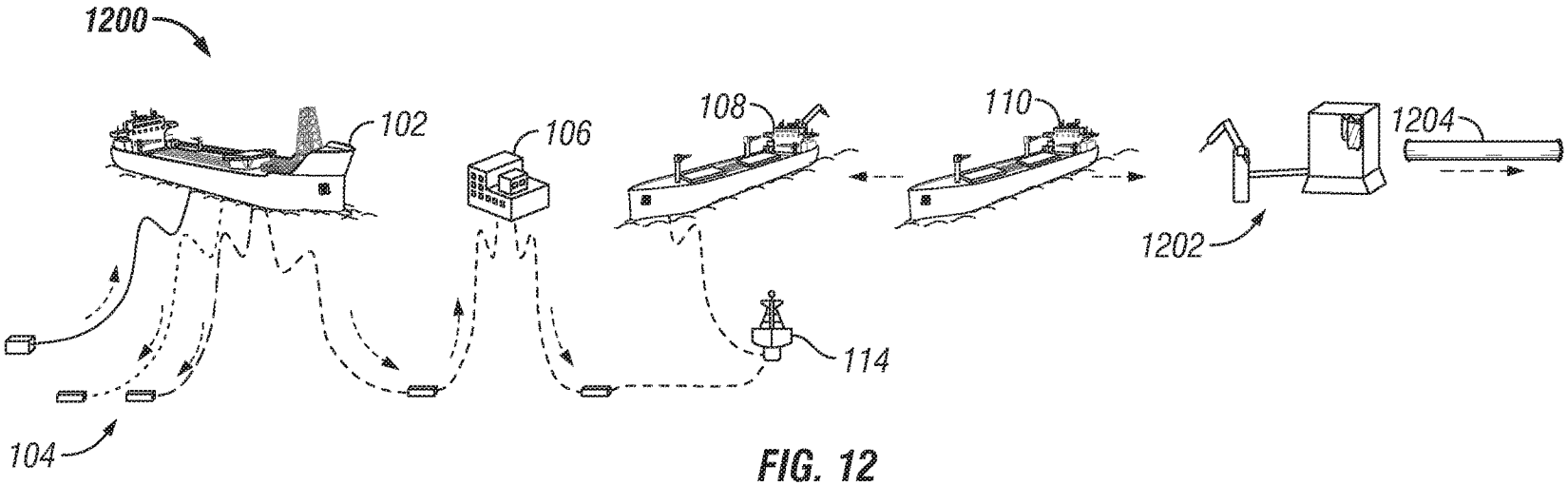
FIG. 12 is a diagram of system for transporting natural gas, according to one or more embodiments.

FIG. 12 a diagram of system 1200 for transporting natural gas, according to one or more embodiments. Similar to FIG. 1, the system 1200 includes a production vessel 102 receiving natural gas from an offshore gas supply source 104, a loading facility 106, an offshore storage system 108, and a CNG carrier 110. However, the CNG carrier 110 delivers the chilled CNG to an onshore storage and offloading facility 1202. The onshore storage and offloading facility 1202 then injects heated, decompressed natural gas into a pipeline 1204.

Figure 13:
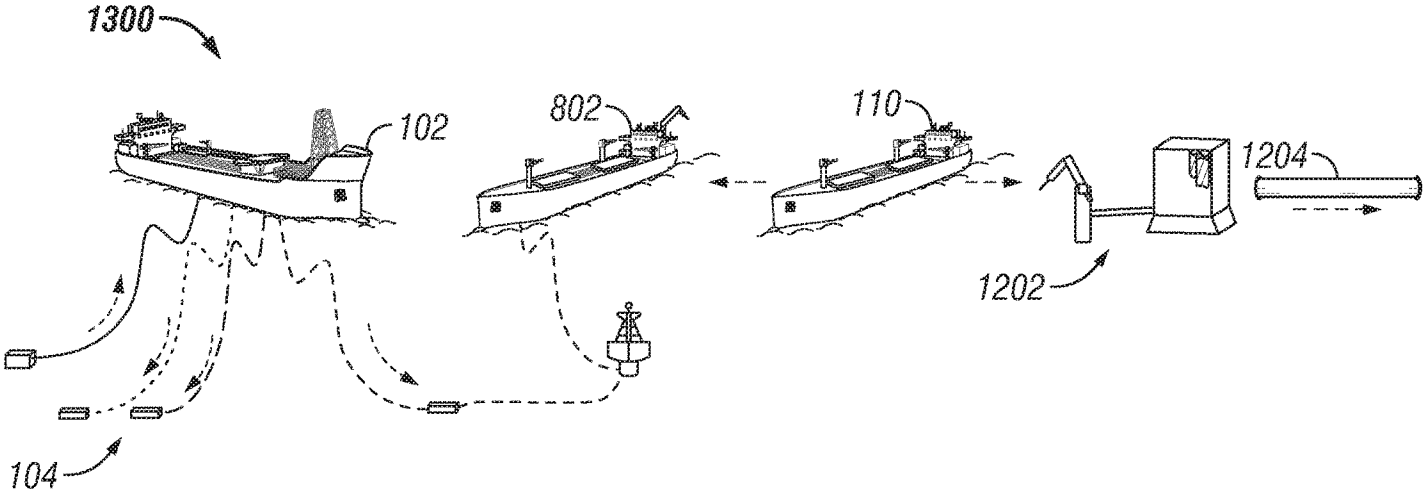
FIG. 13 is a diagram of system for transporting natural gas, according to one or more embodiments.

FIG. 13 a diagram of system 1300 for transporting natural gas, according to one or more embodiments. Similar to FIG. 12, the system 1300 includes a CNG carrier 110 that delivers the chilled CNG to an onshore storage and offloading facility 1202 which injects heated, decompressed natural gas into a pipeline 1204. However, a modified offshore storage system 802 acts as both the loading facility and the offshore storage system, converting the natural gas to chilled CNG and storing the chilled CNG.

Figure 14:
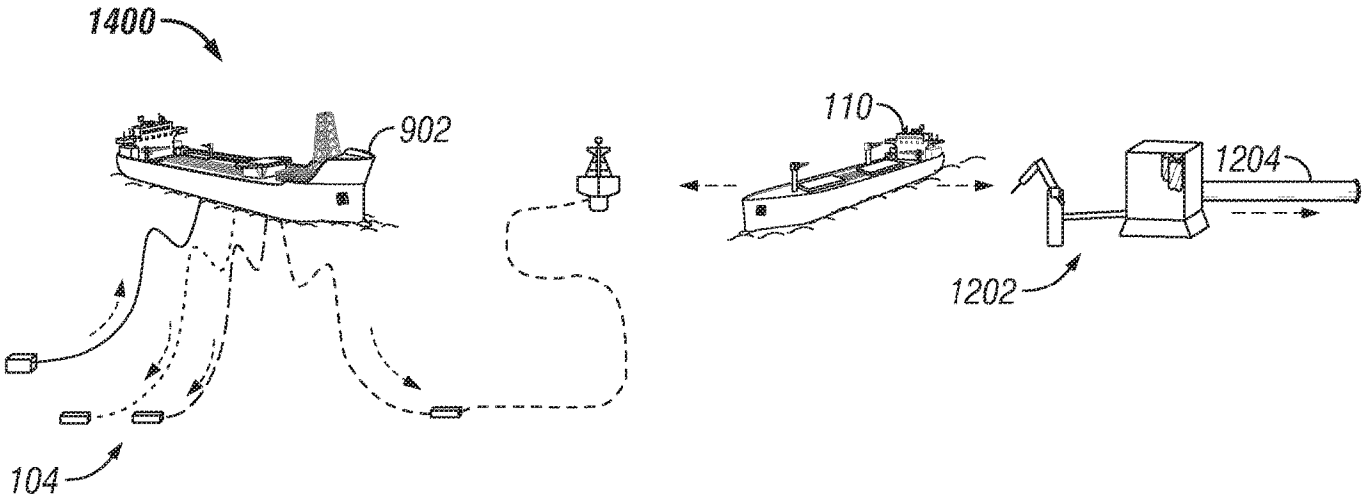
FIG. 14 is a diagram of system for transporting natural gas, according to one or more embodiments.

FIG. 14 a diagram of system 1400 for transporting natural gas, according to one or more embodiments. Similar to FIG. 12, the system 1400 includes a CNG carrier 110 that delivers the chilled CNG to an onshore storage and offloading facility 1202 which injects heated, decompressed natural gas into a pipeline 1204. However, an FGPSO 902 produces natural gas from an offshore gas supply source 104. The FGPSO 902 acts as a production vessel, a loading facility to convert the natural gas to chilled CNG, and an offshore storage system, storing the chilled CNG for offloading to the CNG carrier 110.

Figure 15:
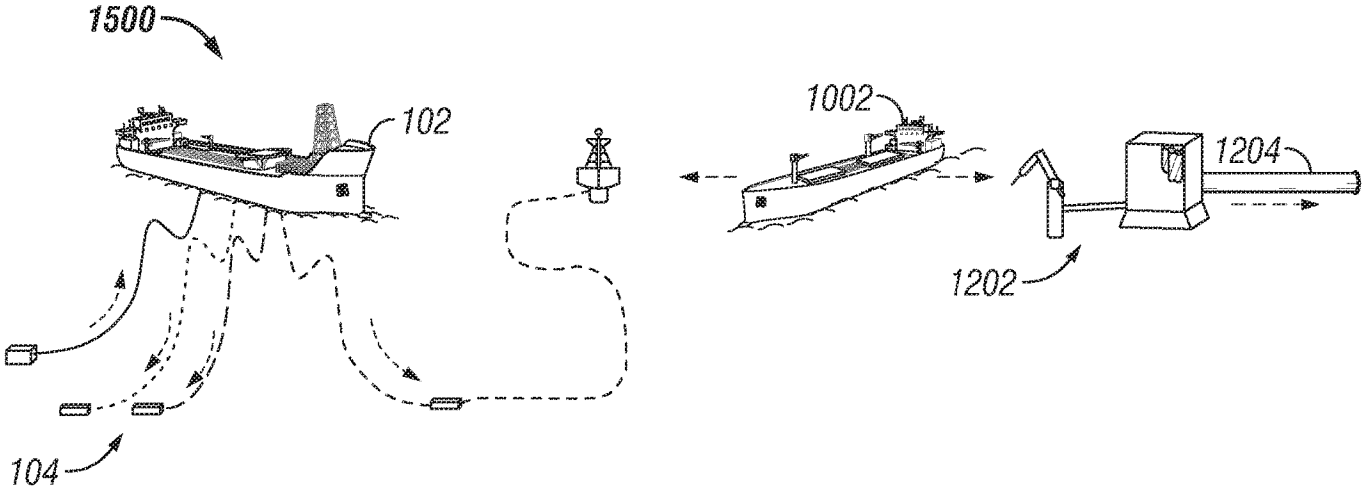
FIG. 15 is a diagram of system for transporting natural gas, according to one or more embodiments.

FIG. 15 a diagram of system 1500 for transporting natural gas, according to one or more embodiments. Similar to FIG. 12, the system 1500 includes a production vessel 102 receiving natural gas from an offshore gas supply source 104 and an onshore storage and offloading facility 1202 which injects heated, decompressed natural gas into a pipeline 1204. However, a modified CNG carrier 1002 acts as the loading facility, the offshore storage system, and the CNG carrier.

Figure 16:
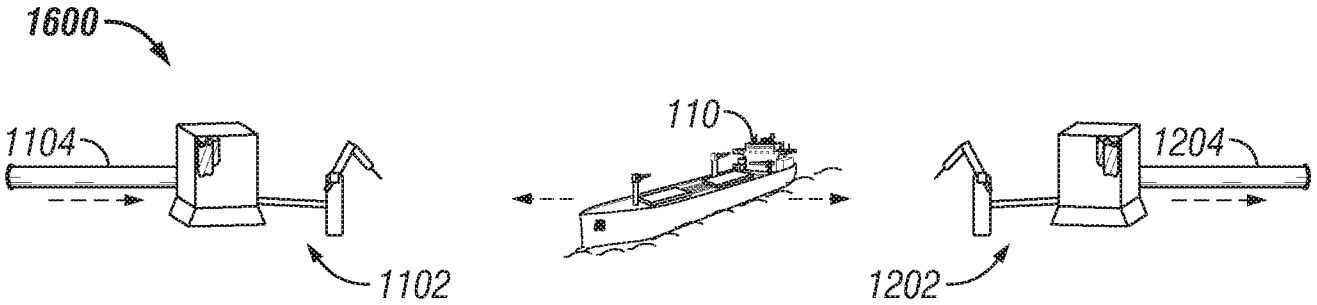
FIG. 16 is a diagram of system for transporting natural gas, according to one or more embodiments.

FIG. 16 a diagram of system 1600 for transporting natural gas, according to one or more embodiments. Similar to FIG. 12, the system 1600 includes a CNG carrier 110 that delivers the chilled CNG to an onshore storage and offloading facility 1202, which injects heated, decompressed natural gas into a pipeline 1204. However, an onshore loading and storage facility 1102 receives natural gas from a pipeline 1104. The onshore loading and storage facility 1102 compresses, chills, and stores the natural gas from the pipeline 1104 for offloading to the CNG carrier 110.

It should be appreciated that, although the preceding examples depict specific onshore and offshore facilities, the invention is not thereby limited. For example, the production vessel may, instead, be an onshore oil and gas production site, or a single loading facility may receive natural gas from multiple offshore production vessels, multiple onshore production sites, multiple pipelines, or any combination of production vessels, onshore production sites, and/or pipelines. Similarly, an offloading facility may deliver natural gas to multiple pipelines, multiple offsite storage facilities, or any combination of pipelines and offsite storage facilities. Further, any combination of onshore and offshore facilities shown in the preceding examples may be used to transport natural gas without departing from the scope of this disclosure.

FURTHER EXAMPLES INCLUDE

Example 1 is a system for transporting natural gas. The system includes a loading facility, a first storage system, a second storage system, and a CNG carrier. The loading facility is operable to receive, compress, and chill natural gas to a temperature at or below 0° C. (32° F.) and a pressure at or above 8,274 kPa (1,200 psi) while maintaining the natural gas in a gaseous state. The loading facility is further operable to transfer the chilled CNG at a constant flowrate while maintaining the chilled CNG in a gaseous state at or below 0° C. (32° F.) and at or above 8,274 kPa (1,200 psi). The first storage system is operable to receive chilled CNG from the loading facility at the constant flowrate, store the chilled CNG, and transfer the chilled CNG while maintaining the chilled CNG in a gaseous state at or below 0° C. (32° F.) and at or above 8,274 kPa (1,200 psi). The second storage system is operable to receive and store the chilled CNG while maintaining the chilled CNG in a gaseous state at or below 0° C. (32° F.) and at or above 8,274 kPa (1,200 psi). The CNG carrier is operable to receive chilled CNG from the first storage system, transport the chilled CNG, and transfer the chilled CNG to the second storage system while maintaining the chilled CNG in a gaseous state at or below 0° C. (32° F.) and at or above 8,274 kPa (1,200 psi). The system is sized such that the constant flowrate from the loading facility to the first storage system is maintained without interruption.

In Example 2, the embodiments of any preceding paragraph or combination thereof further include wherein the first storage system is located offshore.

In Example 3, the embodiments of any preceding paragraph or combination thereof further include wherein the first storage system is located onshore.

In Example 4, the embodiments of any preceding paragraph or combination thereof further include wherein the loading facility is located offshore.

In Example 5, the embodiments of any preceding paragraph or combination thereof further include wherein the loading facility is located onshore.

In Example 6, the embodiments of any preceding paragraph or combination thereof further include an offloading facility operable to receive, heat, decompress, and offload the chilled CNG into a pipeline, wherein the second storage system is further operable to transfer the chilled CNG to the offloading facility.

In Example 7, the embodiments of any preceding paragraph or combination thereof further include wherein the system is sized such that a constant flowrate from the second storage system to the offloading facility is maintained without interruption.

In Example 8, the embodiments of any preceding paragraph or combination thereof further include wherein the second storage system and the offloading facility are both located onshore or the second storage system and the offloading facility are both located offshore.

In Example 9, the embodiments of any preceding paragraph or combination thereof further include wherein the second storage system is located offshore and the offloading facility is located onshore.

Example 10 is a system for transporting natural gas. The system includes an FGPSO, a second storage system, a CNG carrier, and an offloading facility. The FGPSO includes a loading facility and a first storage system. The loading facility is operable to receive, compress, and chill natural gas to a temperature at or below 0° C. (32° F.) and a pressure at or above 8,274 kPa (1,200 psi). The loading facility is further operable to transfer the chilled CNG at a constant flowrate while maintaining the chilled CNG in a gaseous state at or below 0° C. (32° F.) and at or above 8,274 kPa (1,200 psi). The first storage system is operable to receive chilled CNG from the loading facility at the constant flowrate, store the chilled CNG, and transfer the chilled CNG while maintaining the chilled CNG in a gaseous state at or below 0° C. (32° F.) and at or above 8,274 kPa (1,200 psi). The second storage system is operable to receive and store the chilled CNG while maintaining the chilled CNG in a gaseous state at or below 0° C. (32° F.) and at or above 8,274 kPa (1,200 psi). The CNG carrier is operable to receive chilled CNG from the first storage system, transport the chilled CNG, and transfer the chilled CNG to the second storage system while maintaining the chilled CNG in a gaseous state at or below 0° C. (32° F.) and at or above 8,274 kPa (1,200 psi). The offloading facility is operable to receive, heat, decompress, and offload the chilled CNG into a pipeline, wherein the second storage system is further operable to transfer the chilled CNG to the offloading facility. The system is sized such that the constant flowrate from the loading facility to the first storage system is maintained without interruption.

Example 11 is a method of transporting natural gas. The method includes chilling and compressing the natural gas received at a loading facility at a constant flowrate to a temperature at or below 0° C. (32° F.) and a pressure at or above 8,274 kPa (1,200 psi) while maintaining the chilled CNG in a gaseous state. The method also includes transporting the chilled CNG to a first storage system at the constant flowrate while maintaining the chilled CNG in a gaseous state at or below 0° C. (32° F.) and at or above 8,274 kPa (1,200 psi). The method further includes transferring the chilled CNG from the first storage system to a CNG carrier while maintaining the chilled CNG in a gaseous state at or below 0° C. (32° F.) and at or above 8,274 kPa (1,200 psi) such that the flowrate from the loading facility to the first storage system is maintained without interruption. The method also includes transferring the chilled CNG from the CNG carrier to a second storage system while maintaining the chilled CNG in a gaseous state at or below 0° C. (32° F.) and at or above 8,274 kPa (1,200 psi).

In Example 12, the embodiments of any preceding paragraph or combination thereof further include wherein the first storage system is located offshore.

In Example 13, the embodiments of any preceding paragraph or combination thereof further include wherein the first storage system is located onshore.

In Example 14, the embodiments of any preceding paragraph or combination thereof further include wherein the loading facility is located offshore.

In Example 15, the embodiments of any preceding paragraph or combination thereof further include wherein the loading facility is located onshore.

In Example 16, the embodiments of any preceding paragraph or combination thereof further include transferring the chilled CNG from the second storage system to an offloading facility while maintaining the chilled CNG in a gaseous state at or below 0° C. (32° F.) and at or above 8,274 kPa (1,200 psi). The method also includes decompressing and heating the chilled CNG at the offloading facility. The method further includes offloading the heated, decompressed natural gas to a pipeline at a second flowrate.

In Example 17, the embodiments of any preceding paragraph or combination thereof further include wherein a constant flowrate from the second storage system to the offloading facility is maintained without interruption.

In Example 18, the embodiments of any preceding paragraph or combination thereof further include wherein the second storage system and the offloading facility are both located onshore or the second storage system and the offloading facility are both located offshore.

In Example 19, the embodiments of any preceding paragraph or combination thereof further include wherein the second storage system is located offshore and the offloading facility is located onshore.

In Example 20, the embodiments of any preceding paragraph or combination thereof further include wherein the loading facility and the first storage system are both located on an FGPSO.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for transporting natural gas, the system comprising:

a loading facility operable to receive, compress, and chill natural gas to a temperature at or below 0° C. (32° F.) and a pressure at or above 8,274 kPa (1,200 pounds per square inch ("psi")) while maintaining the natural gas in a gaseous state, the loading facility further operable to transfer the chilled compressed natural gas ("CNG") at a constant flowrate while maintaining the chilled CNG in a gaseous state at or below 0° C. (32° F.) and at or above 8,274 kPa (1,200 psi);

a first storage system operable to receive chilled CNG from the loading facility at the constant flowrate, store the chilled CNG, and transfer the chilled CNG while maintaining the chilled CNG in a gaseous state at or below 0° C. (32° F.) and at or above 8,274 kPa (1,200 psi);

a second storage system operable to receive and store the chilled CNG while maintaining the chilled CNG in a gaseous state at or below 0° C. (32° F.) and at or above 8,274 kPa (1,200 psi);

a CNG carrier operable to receive chilled CNG from the first storage system, transport the chilled CNG, and transfer the chilled CNG to the second storage system while maintaining the chilled CNG in a gaseous state at or below 0° C. (32° F.) and at or above 8,274 kPa (1,200 psi); and wherein the system is sized such that the constant flowrate from the loading facility to the first storage system is maintained without interruption.

2. The system of claim 1, wherein the first storage system is located offshore.

3. The system of claim 1, wherein the first storage system is located onshore.

4. The system of claim 1, wherein the loading facility is located offshore.

5. The system of claim 1, wherein the loading facility is located onshore.

6. The system of claim 1, further comprising an offloading facility operable to receive, heat, decompress, and offload the chilled CNG into a pipeline, wherein the second storage system is further operable to transfer the chilled CNG to the offloading facility.

7. The system of claim 6, wherein the system is sized such that a constant flowrate from the second storage system to the offloading facility is maintained without interruption.

8. The system of claim 6, wherein the second storage system and the offloading facility are both located onshore or the second storage system and the offloading facility are both located offshore.

9. The system of claim 6, wherein the second storage system is located offshore and the offloading facility is located onshore.

10. A system for transporting natural gas, the system comprising:

a floating gas production, storage, and offloading facility ("FGPSO") comprising:

a loading facility operable to receive, compress, and chill natural gas to a temperature at or below 0° C. (32° F.) and a pressure at or above 8,274 kPa (1,200 psi), the loading facility further operable to transfer the chilled compressed natural gas ("CNG") at a constant flowrate while maintaining the chilled CNG in a gaseous state at or below 0° C. (32° F.) and at or above 8,274 kPa (1,200 psi); and a first storage system operable to receive chilled CNG from the loading facility at the constant flowrate, store the chilled CNG, and transfer the chilled CNG while maintaining the chilled CNG in a gaseous state at or below 0° C. (32° F.) and at or above 8,274 kPa (1,200 psi);

a second storage system operable to receive and store the chilled CNG while maintaining the chilled CNG in a gaseous state at or below 0° C. (32° F.) and at or above 8,274 kPa (1,200 psi);

a CNG carrier operable to receive chilled CNG from the first storage system, transport the chilled CNG, and transfer the chilled CNG to the second storage system while maintaining the chilled CNG in a gaseous state at or below 0° C. (32° F.) and at or above 8,274 kPa (1,200 psi);

an offloading facility operable to receive, heat, decompress, and offload the chilled CNG into a pipeline, wherein the second storage system is further operable to transfer the chilled CNG to the offloading facility; and wherein the system is sized such that the constant flowrate from the loading facility to the first storage system is maintained without interruption.

11. A method of transporting natural gas, the method comprising:

chilling and compressing the natural gas received at a loading facility at a constant flowrate to a temperature at or below 0° C. (32° F.) and a pressure at or above 8,274 kPa (1,200 psi) while maintaining the chilled compressed natural gas ("CNG") in a gaseous state; then transporting the chilled CNG to a first storage system at the constant flowrate while maintaining the chilled CNG in a gaseous state at or below 0° C. (32° F.) and at or above 8,274 kPa (1,200 psi); then transferring the chilled CNG from the first storage system to a CNG carrier while maintaining the chilled CNG in a gaseous state at or below 0° C. (32° F.) and at or above 8,274 kPa (1,200 psi) such that the flowrate from the loading facility to the first storage system is maintained without interruption; and then transferring the chilled CNG from the CNG carrier to a second storage system while maintaining the chilled CNG in a gaseous state at or below 0° C. (32° F.) and at or above 8,274 kPa (1,200 psi).

12. The method of claim 11, wherein the first storage system is located offshore.

13. The method of claim 11, wherein the first storage system is located onshore.

14. The method of claim 11, wherein the loading facility is located offshore.

15. The method of claim 11, wherein the loading facility is located onshore.

16. The method of claim 11, wherein the loading facility and the first storage system are both located on a floating gas production, storage, and offloading facility.

17. The method of claim 11, further comprising:

transferring the chilled CNG from the second storage system to an offloading facility while maintaining the chilled CNG in a gaseous state at or below 0° C. (32° F.) and at or above 8,274 kPa (1,200 psi); then decompressing and heating the chilled CNG at the offloading facility; and then offloading the heated, decompressed natural gas to a pipeline at a second flowrate.

18. The method of claim 17, wherein a constant flowrate from the second storage system to the offloading facility is maintained without interruption.

19. The method of claim 17, wherein the second storage system and the offloading facility are both located onshore or the second storage system and the offloading facility are both located offshore.

20. The method of claim 17, wherein the second storage system is located offshore and the offloading facility is located onshore.

* * * * *